US005545119A

United States Patent [19]

Schilp et al.

[11] Patent Number: 5,545,119

[45] Date of Patent: Aug. 13, 1996

[54] SOLID BOWL WORM CENTRIFUGE

[75] Inventors: Reinhold Schilp, Woerthsee; Wolfgang Epper, Bergheim-Kenten, both of Germany

[73] Assignee: Kloeckner-Humboldt-Deutz Aktiengesellschaft, Cologne, Germany

[21] Appl. No.: 362,756

[22] Filed: Dec. 22, 1994

Related U.S. Application Data

[63] Continuation of Ser. No. 47,778, Apr. 15, 1993, abandoned, which is a continuation of Ser. No. 594,705, Oct. 9, 1990, abandoned.

[30] Foreign Application Priority Data

Oct. 17, 1989 [DE] Germany ..... 39 34 612.9
Feb. 23, 1990 [DE] Germany ..... 40 05 755.0

[51] Int. Cl.[6] ..... B04B 1/10; B04B 11/08

[52] U.S. Cl. ..... 494/56; 494/53

[58] Field of Search ..... 494/37, 50, 52, 494/53, 54, 55, 56, 58, 59, 79, 80, 85, 23, 27; 210/781, 782, 360.1

[56] References Cited

U.S. PATENT DOCUMENTS

| | | | |
|---|---|---|---|
| 2,174,857 | 10/1939 | Vogel-Jorgensen | 494/54 |
| 2,435,623 | 2/1948 | Forsberg | 494/56 |
| 3,279,687 | 10/1966 | Amero | 494/56 |
| 3,423,015 | 1/1969 | O'Conor | 494/27 |
| 3,471,081 | 10/1969 | O'Conor | 494/27 |
| 4,334,647 | 6/1982 | Taylor | 494/37 |
| 4,509,942 | 4/1985 | Gunnewig | 494/56 |
| 4,566,873 | 1/1986 | Toda | 494/56 |
| 4,714,456 | 12/1987 | Bender et al. | 494/53 |
| 4,743,226 | 5/1988 | Day et al. | 494/53 |
| 4,784,634 | 11/1988 | Schiele | 494/52 |

FOREIGN PATENT DOCUMENTS

| | | | |
|---|---|---|---|
| 0645799 | 4/1964 | Belgium | 494/53 |
| 1387605 | 12/1964 | France | 494/53 |
| 0904999 | 2/1954 | Germany | 494/51 |
| 2907318 | 8/1980 | Germany | 494/54 |
| 3318064 | 11/1984 | Germany | 494/53 |
| 3904151 | 8/1990 | Germany | 494/53 |
| 513243 | 7/1957 | Italy | 494/53 |
| 0146304 | 7/1954 | Sweden | 494/51 |
| 364348 | 1/1932 | United Kingdom | 494/53 |
| 1059355 | 2/1967 | United Kingdom | 494/53 |

*Primary Examiner*—David Scherbel
*Assistant Examiner*—Tony G. Soohoo
*Attorney, Agent, or Firm*—Hill, Steadman & Simpson

[57] ABSTRACT

An apparatus for the centrifugal separation of a solid-liquid mixture including an elongate centrifuge drum rotatable about a central axis, a coaxially located conveyor worm within the drum having worm helix flights on a worm drum therein, an opening for the discharge of a light fraction and an opening for the discharge of a heavy fraction, the opening for the discharge of the light fraction located in a radius from the drum axis less than the radius of the worm drum and the opening for the heavy fraction being located at a radius relative to the axis of the drum less than the radius of the worm drum.

8 Claims, 3 Drawing Sheets

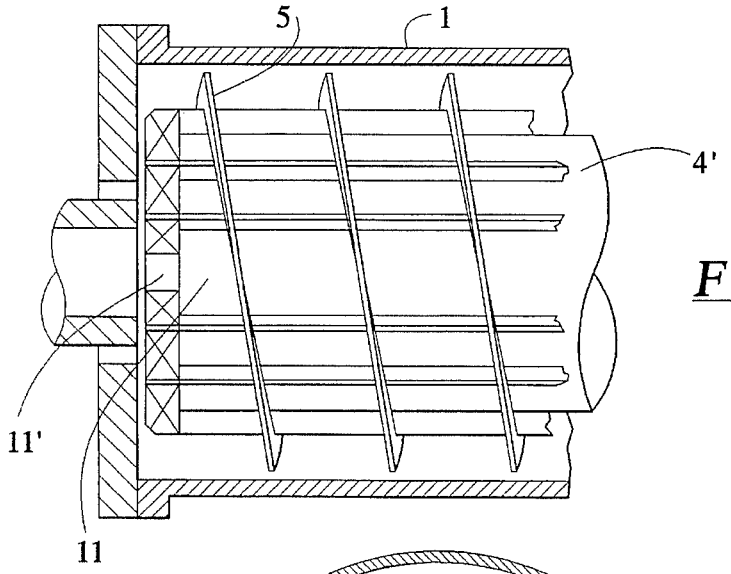
FIG. 4
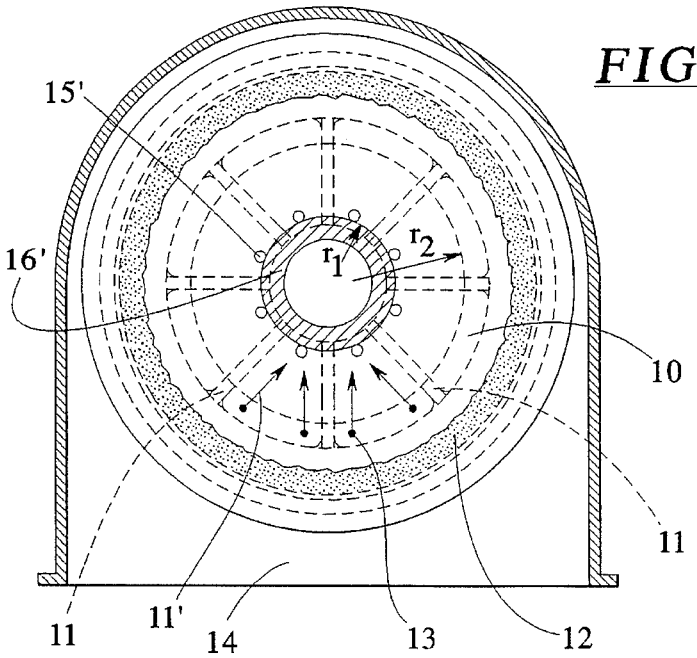
FIG. 5
FIG. 6
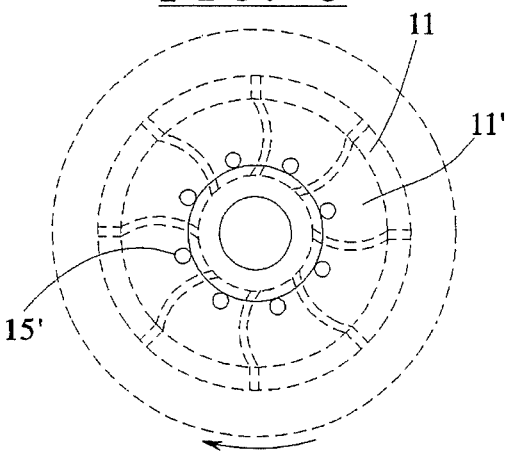
FIG. 7
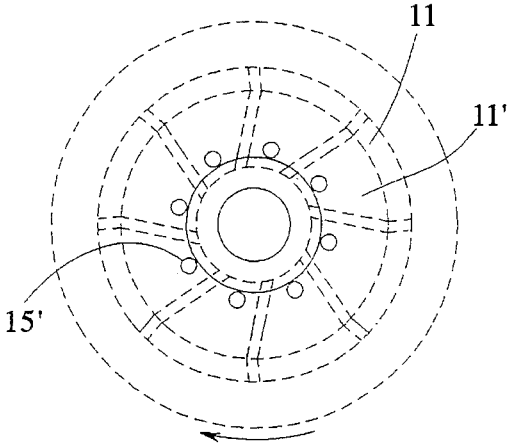

SOLID BOWL WORM CENTRIFUGE

This is a continuation of application Ser. No. 08/047,778, filed Apr. 15, 1993, now abandoned which is a continuation of application Ser. No. 07/594,705, filed Oct. 9, 1990, now abandoned.

BACKGROUND OF THE INVENTION

The invention relates to improvements in centrifugal separators for separating solid-liquid mixtures into a liquid fraction and a heavier fraction. More particularly, the invention relates to improvements in a centrifuge drum which is rotatable about a longitudinal axis and has therein a conveyor worm which rotates at a different speed and the material to be separated is discharged along the axis of the drum and separate openings are provided for the discharge of the separated light and separated heavy substances.

In the field of this development, German Published Application 33 17 047 discloses a cylindrical solid bowl worm centrifuge of the above general type for separating suspensions. This centrifuge includes a separating disk at one end of the separating space that provides an annular gap between the disk and the drum. Clear phase channels that discharge into a clear phase discharge line are radially arranged at the worm member at a distance preceding the separating disk. A sediment channel proceeds radially and is arranged immediately following the separating disk. This sediment channel discharges into a sediment discharge line that is coaxially arranged relative to the clear phase discharge line. This known structure provides disadvantages in that it can be only utilized for separating thin bodied agents due to the risk of occluding the discharge channels. Over and above this, the material has to be supplied to the centrifuge pressure and the centrifuge can be operated only under pressure. In order to accomplish this, the centrifuge must be provided with special seals, particularly axial face seals both in the material admission region as well as in the discharge region where the agents are separated from one another. These seals not only have to be frequently changed because of rapid wear but are relatively complicated in structure which involves a high initial cost. Further, the liquid discharges through the hollow centrifugal shaft and thereby requires a special hollow shaft gearing for the worm drive. This is relatively complicated and costly. A solid bowl worm centrifuge is disclosed in U.S. Pat. No. 4,566,873 and is basically identically fashioned and is disadvantageous in the same manner.

It is accordingly an object of the present invention to provide a solid bowl worm centrifuge which avoids the above disadvantages of structures heretofore available. A further object of the invention is to provide an improved solid bowl worm centrifuge which is unique in having a simple structural format and is particularly advantageous in having extremely low energy consumption relative to the high separation ability and enables continuous separation of solid-liquid mixtures.

FEATURES OF THE INVENTION

A feature of the invention is that the solid bowl centrifuge is provided with a discharge opening for light substances and a discharge opening for heavy substances. The discharge opening for the light substances is in particular located at a smaller radial distance from the centrifugal drum axis than the outer circumference of the worm drum.

The spatial and structural arrangements enable the centrifuge to operate in an unpressurized manner so that the solid-liquid mixture does not have to be pressurized as heretofore necessary. The discharge of the mixture into the separating space of the centrifuge and the discharge of the substances are accomplished without the provision of special axial face seals. A separation and discharge of the liquid separated from the solid is achieved by a major part of the kinetic energy that resides in the suspension in the separating space being recovered. In known centrifuges of a general similar construction, this kinetic energy was lost and thereby a significantly lower energy consumption is achieved for an improved separation capability.

In accordance with the invention, the worm drum has pump-like baffle elements arranged in the location where a liquid-solids mixture to be separated is admitted. The baffle elements may be arranged to be separated or arranged as turbine-like baffle elements particularly for the region where the lighter substances are discharged. An especially uniform distribution of the solid-liquid mixture in the separating space of the centrifuge is achieved by the arrangement of the pump-like baffle elements in the admission region.

A considerable saving of kinetic energy is obtained in the use of the turbine-like or pump-like baffle element and their flow channels are arranged radially or obliquely angled as well as straight or curved.

Other advantages and features will become more apparent with the teaching of the principles of the invention in connection with the disclosure of the preferred embodiments thereof in the specification, claims and drawings, in which:

DESCRIPTION OF THE DRAWINGS

FIG. 4 is a partial sectional view of the light discharge end of the centrifugal bowl with the worm drum shown in elevation.

FIG. 5 is a sectional view taken generally along the line V—V of FIG. 1.

FIG. 6 is a fragmentary schematic view of the light discharge end of the worm drum.

FIG. 7 is a fragmentary schematic view of an alternate embodiment of the worm drum.

DESCRIPTION OF THE PREFERRED EMBODIMENTS

Figure 1:
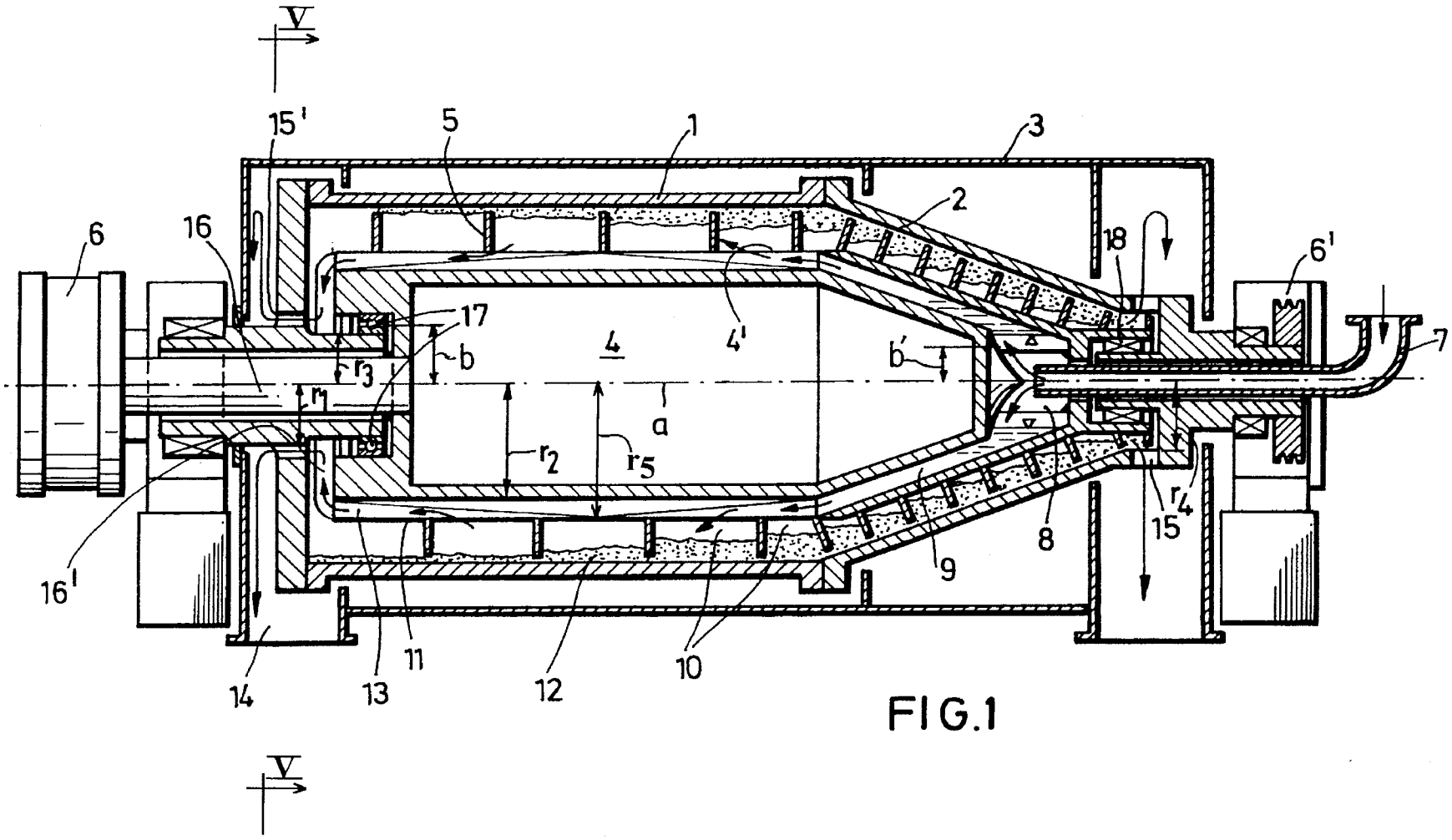
FIG. 1 is an axial sectional view taken through a centrifuge constructed and operating in accordance with the principles of the present invention.

FIG. 1 illustrates a solid bowl centrifuge having a first end shown at the left in FIG. 1 and a second end shown at the right in FIG. 1. The bowl includes a cylindrical solid bowl 1 having a conical bowl portion 2 tapering in the direction toward the discharge of heavy substances at the second end. The bowl consisting of the cylindrical portion and conical portion is supported for rotation at the second end in an outer housing 3.

Within the bowl 1 is a conveyor worm 5 and a worm drum 4' having a hollow interior 4 has a worm helix 5 arranged thereon. This conveyor worm is rotatably supported coaxially within the outer solid bowl.

A drive 6 shown at the first end is provided for the conveyor worm which is driven at a speed independent of the speed of rotation of the outer bowl. A drive 6' shown at the second end is provided for the centrifugal bowl 1, 2 situated at the right-hand side of the drawing of FIG. 1.

An admission line 7 for the admission of the solids-liquid mixture leads axially into the centrifuge i.e., drum. This line 7 discharges into a distributor chamber 8 which leads to outwardly facing axially extending flow channels 9, 13. The flow channels are formed in the outer cylindrical surface of the worm drum 4' and the drum tapers to a frusto-conical extension toward the second end. The worm helixes 5 are mounted on an outer cylindrical surface of the drum 4'. A plurality of baffle elements or worm helixes function as a pump and have spaces 10 therebetween. The worm helixes discharge the heavier fraction into the separating space located between the worm drum 4' and the centrifuge bowl 1, 2.

The flow channels 9 and 11 extend axially along the outer surface of the worm drum 4 being radially open to permit the heavier fraction to pass radially outwardly. The heavier fraction passes outwardly from the channels and is carried toward the second end by the worm helixes. The liquid flows along the channels 9, 11 toward a liquid discharge opening 14 with the liquid flowing first directly from an end of the flow channel 11 into a radial passage 11' and then through axially extending passages 15' in the end wall of the drum. These discharge openings 15' are located at a radial distance $r_1$ from the centrifugal bowl axis a. This radial distance $r_1$ is at a smaller radial distance than the radius $r_2$ of the channels and $r_5$ of the outside circumference of the worm drum 4'.

As shown at the left-hand side of FIG. 1, the worm drum is supported on a hub 16' carried on a hub 16'. The drum shaft hub 16' has an outer circumference $r_3$. The radial distance $r_1$ of the liquid phase openings is greater than the radius $r_3$ of the hub 16' on which the drum is supported. The drum is supported by bearings 17 on the hub.

This structural arrangement not only advantageously enables a completely unpressurized admission of the solid-liquid mixture into the separating space of the centrifuge and also accomplishes the discharge of the substances separated from each other in an unpressurized manner. This eliminates the necessity of special axial face seals. It also provides the advantage that a large part of the kinetic energy that resides in the suspension in the separating space of the centrifuge is recovered.

It is also significant that the radial spacing $r_4$ of the discharge openings 15 for the heavy substances located at the radius $r_5$ is less than the distance $r_2$ of the outside of the worm drum 4' but greater than $r_1$ which is the distance of the outlet 15' for liquid.

As illustrated in the drawings, the radius measurements are indicated to the edge of the opening at the closest distance to the axis of the bowl.

During operation of the solid bowl worm centrifuge shown in FIG. 1, the conveyor worm 5 is driven with speeds that differ relative to the centrifuge drum. The solid-liquid mixture is supplied unpressurized to the centrifuge on the outside via the conduit 7. The separation of the solids, that is, the thick substances from the liquid occurs in the separating space 10 of the centrifuge, due to the action of the centrifugal forces. The discharge of the heavy substances occurs at the end of the centrifuge drum which is opposite the end for the discharge of light substances. Liquids separated from the solids are directed to the liquid discharge 14 via the flow channels 11. These flow channels 11 first proceed parallel to the worm shaft and then subsequently proceed radially inwardly at 11' and the liquid is thus discharged from the centrifugal drum. The solids 12 are carried by the worm helix 5 and are conveyed via the conical basket shell part 2 and are discharged from the centrifuge drum via radial openings 15.

Baffle elements fashioned as flow channels 9 deflect the solid-liquid mixture radially emerging from the material admission pipe into an axial flow in the separating space 10 of the centrifuge. The solid-liquid mixture emerges from the material admission pipe 7 and is seized by the baffle elements which are structured as flow channels 9. These act as turbine-like or pump-like elements and co-rotate with the conveyor worm. These baffle elements accelerate the solid-liquid mixture until the mixture reaches the required high circumferential speed of the rotating separating space. This increase in speed is accomplished in the rotational direction with high efficiency and extremely low frictional losses. The predominantly radial flow direction of the solid-liquid mixture is advantageously deflected into the axial flow direction in the separating space 10 free of energy losses. The flow moving therein, helically or axially directed, orbits on a large radius to the discharge end of the centrifugal drum. Heavy constituents are separated from the lighter constituents under the influence of centrifugal force. The liquid that is separated from the solids is guided on the smallest possible radius by the turbine-like or pump-like flow channels 11 which are obliquely angled, at 11*a*, FIG. 5, straight, at 11, FIG. 4, or curved, at 11*b*, FIG. 6, and the liquid is guided practically without energy loss to the radial passages 11' which may be formed by curved walls 11", FIG. 11, angled walls 11''', FIG. 12 or as cylindrical passage 11*a'*, FIG. 9. The liquid emerges unpressurized from the drum through the openings 15' next to the drive shaft 16 of the conveyor worm 5. The flow channels are shown at 11*a* obliquely angled in FIG. 5, as straight at 11 in FIG. 5, and as curved at 11*b* in FIG. 6.

The solid that is separated from the liquid is likewise conveyed on an optimally small radius via the conical jacket part 12. This is conveyed with the assistance of the conveyor worm 4 and is discharged with extremely low kinetic energy from the centrifugal drum through the openings 15. The radial distance $r_4$ of the discharge openings for the heavy substances is smaller than the greatest radial distance $r_2$ of the outside surface of the worm drum 4'. In order to promote the solids conveying in the conical basket shell part 2, other conveying aids such as, for example, the pressure action of the clear phase in combination with a retarding disk and a negative pond level may also be utilized.

The bearings 17 and 18 of the conveyor worm are located at a radial distance b and b' from the axis a of the drum. These distances b and b' are smaller than the radius of the discharge openings 15 and 15' for the solids and for the liquid. As a result, the bearings 17 and 18 are reliably protected against spray and contamination.

Figure 2:
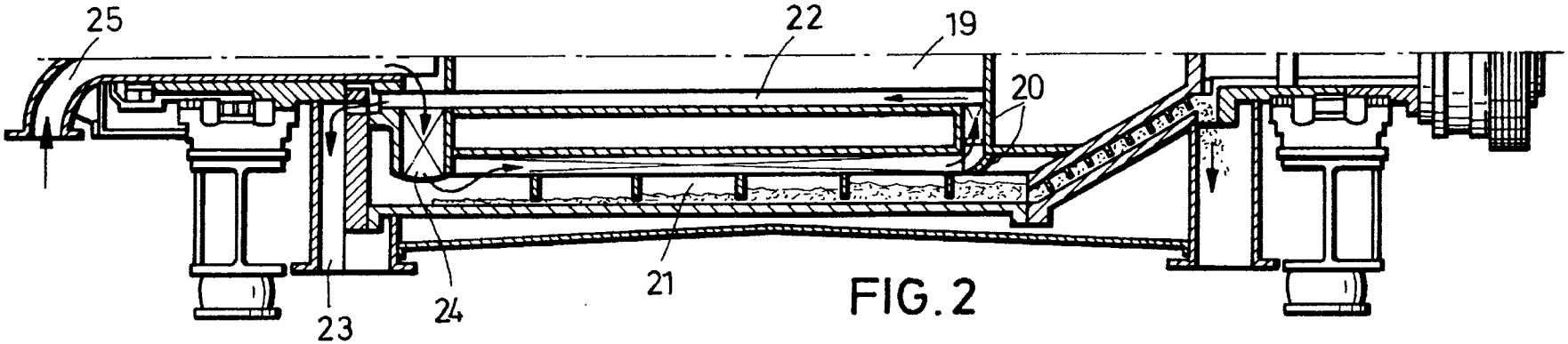
FIG. 2 is an axial sectional view with the top half omitted illustrating a modification of structure of the invention.

As illustrated in FIG. 2, the solid bowl centrifuge principles of the invention can be utilized as a co-current centrifuge. Channels 20, 22 are arranged at the outside of the hollow worm shaft 19 and the liquid is conducted in co-current flow in the separating space 21 and separated from the solids proceeding through the channels 20, 22. The material flows after being inwardly directed via flow channels 20, 22 into the liquid discharge conduit 23. Turbine-like or pump-like baffle elements 24 are advantageously arranged at the hollow conveyor shaft 19 in the area of the admission of the liquid-solids material. These baffle elements deflect the solid-liquid mixture that emerges from the admission pipe 25 into an axial flow in the separating space 21 of the centrifuge without energy losses.

Figure 3:
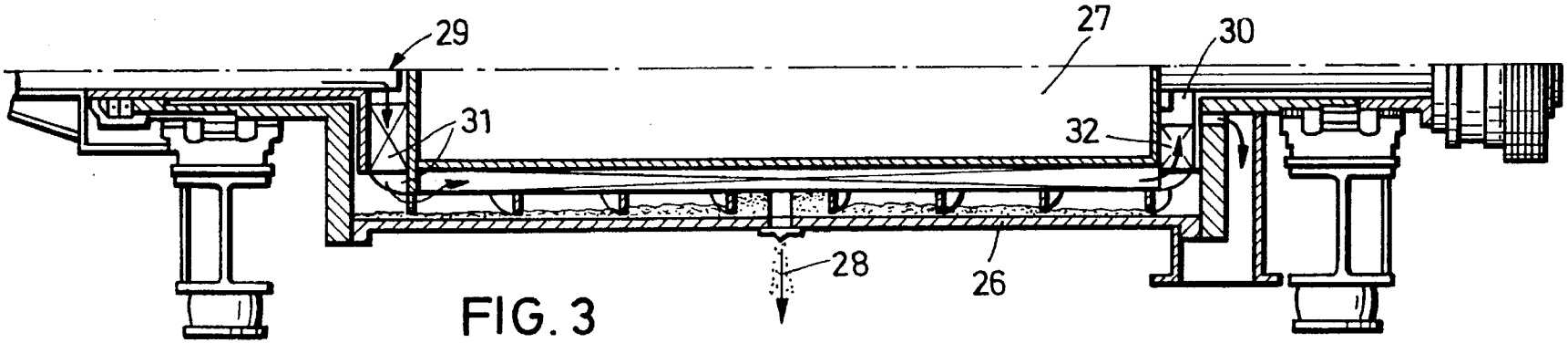
FIG. 3 is an axial sectional view with the top half omitted showing a separator arranged for a co-current—countercurrent flow.

As illustrated in FIG. 3, the solid bowl worm centrifuge can be utilized in principle as a co-current and countercurrent centrifuge. A centrifuge drum 26 and conveyor worm 27 are cylindrically shaped and the discharge of solids occurs at 28 in the center of the centrifuge drum 26. Baffle elements 31 and 32 shaped turbine-like or pump-like in conformity with the invention are also arranged at the conveyor worm 27 in the material admission region 29 and the liquid discharge region 30. These baffles deflect the solid-liquid mixture that radially emerges from the material admission pipe into an axial flow in the separating space of the centrifuge to radially deflect the liquid separated from the solid laterally inwardly toward the liquid discharge. In this co-current and countercurrent solid bowl worm centrifuge, the baffle elements yield the same advantages as they do in the solid bowl centrifuge shown in FIGS. 1 and 2. The turbine-like or pump-like baffle elements 31 and 32 provide a plurality of flow channels and can be arranged to proceed radially or obliquely angled either straight or curved as well and particularly helically. They act as a pump wheel or turbine wheel during operation of the centrifuge. Dependent on the need and the solid-liquid mixture to be separated, the cross-section of the flow channels can be fashioned round or angular to enable an optimally impact-free operation. The baffle acting like a pump wheel can be arranged at the drum instead of being arranged at the worm, thus yielding the same advantages. As needed, discharges can be provided that are easily separated for more than two substances separated from each other in the centrifuge and can be provided at the centrifuge drum. What is critical is that the constituents separated in the centrifuge, that is, the greater constituent in terms of amount conducted, is optimally far in the inward direction and is discharged unpressurized toward the outside. This is necessary to operate the centrifuge with significant lower energy expenditure and capital outlay compared to previously known centrifuges.

The energy saving that is achieved in comparison to previous known centrifuges derives from the following calculation.

In order to bring the suspension to the circumferential speed required in the separating space of the centrifuge, the acceleration power can be calculated according to the following empirical equation:

$$P_B = 3.81 \times 10^{-7} \times \frac{1}{n} \times m \times D^2 \times n^2 \text{ (kW)}$$

Thereby denoting are:

m the throughput power (t/h).

D the diameter of the centrifuge drum (m).

n the drum revolutions per minute (rpm).

$^n$ the efficiency of the centrifuge.

In known centrifuges, the efficiency $^n$ generally lies at approximately 50%. Due to the inventive fashioning of the solid bowl worm centrifuge, namely particularly due to the arrangement of the turbine-like or pump-like baffles or, respectively, flow channels, the energy outlay given an otherwise identical separating power of the centrifuge is very drastically reduced to approximately 1/6 of the energy hitherto required:

$$P_B = 0.7 \times 10^{-7} \times m \times D^2 \times n^2 \text{ (kW)}$$

This calculation is based on an efficiency $^n$ of 0.80 and on reduced admission and spray radii of approximately ⅓× the inside drum diameter D.

In addition to the extremely low energy consumption for the drive, the centrifuge is distinguished by its simple and operationally reliable mechanical structure. It also has the feature of low friction and low product damage, or in other words, low flake and cell destruction. It is also insensitive to rough substances or individual heavy particles in the charging material.

Both axial face seals for the worm bearings as well as hollow shaft gearings for the worm drive are eliminated. A substantial reduction in capital and operating costs are thereby achieved. The development of noise, that is, the noise level of the centrifuge is also substantially lower in comparison to known centrifuges and the throughput and separating power are significantly higher.

We claim as our invention:

1. A solid bowl worm centrifuge for the continuous separating of a solids/liquid mixture, including an elongate centrifuge bowl, having a face wall at one end, that is rotatably seated around its longitudinal axis, by means of a centrifuge drum shaft, and that surrounds a coaxially arranged, generally cylindrical, conveyor worm drum rotating with a divergent speed, worm helices thereof being secured to a circumference of the worm drum, whereby a product admission conduit means for delivering to be separated in the drum are provided along the axis thereof, as well as light and heavy discharge openings for the discharge of the separated light and heavy substances, comprising:

a plurality of baffle elements provided on the outside of the conveyor worm drum uniformly distributed over the circumference thereof and fashioned as flow channels, a) the baffle elements comprising axially extending walls to deflect the solids/liquid mixture emerging radially pressureless from the product admission conduit into an axial flow, b) said baffle elements, by means of said axially extending walls, convey the liquid and light substances separated from the solids parallel to the conveyor worm drum in the direction of the discharge opening for the light substances, c) said baffle elements extending along a length of said conveyor worm and continuing into a radial passage leading to said discharge opening for the light substances in order to deflect the light substances radially inward to the discharge opening for the light substances, d) the flow channels formed by said baffle elements are in fluid communication with one another, and discharge openings for the light substances are arranged outside the centrifuge drum shaft at the face wall of the centrifuge and have a smaller radial spacing from the centrifuge axis than the greatest radial spacing of an outside surface of the worm drum from the centrifuge axis.

2. A solid bowl worm centrifuge according to claim 1, wherein the baffle elements are arranged radially at the outside of the conveyor worm.

3. A solid bowl worm centrifuge according to claim 1, wherein the baffle elements are arranged oblique-angled at the outside of the conveyor worm.

4. A solid bowl worm centrifuge according to claim 1, wherein the baffle elements are arranged straight at the outside of the conveyor worm.

5. A solid bowl worm centrifuge according to claim 1, wherein the baffle elements are arranged curved at the outside of the conveyor worm.

6. A solid bowl worm centrifuge according to claim 1, wherein the discharge for the heavy substances is provided at that end of the centrifuge drum opposite the discharge for the light substances.

7. A solid bowl worm centrifuge according to claim 1, wherein the discharge for the heavy substances is provided in the middle of the centrifuge drum.

8. A solid bowl worm centrifuge for the continuous separation of a solids/liquid mixture comprising in combination:

an elongate centrifuge bowl rotatably seated for rotation about its longitudinal axis;

a coaxially arranged conveyor worm drum within the bowl rotatable with a divergent speed relative to the bowl and having worm helices outwardly thereof being secured to the drum;

a product admission conduit leading into the bowl to the drum;

separate light and heavy discharge openings in the bowl for the separate discharge of light and heavy substances;

a plurality of generally axially extending turbine-like baffle elements on the circumferential outside of the conveyor drum uniformly distributed over the circumference thereof and fashioned as flow channels;

said baffle elements extending along a length of said conveyor worm drum and continuing into a radial passage leading to said discharge opening for the light substances in order to deflect the light substances radially inward to the discharge opening for the light substances;

means for directing a suspension flowing through the admission conduit to the drum radially outwardly with the radially outwardly directed flow deflected then to an axial flow to said baffle elements; and conveyor worm elements carried on the drum and shaped to direct the heavy substances toward the heavy discharge openings and located radially outside the baffle elements.

* * * * *